US010709238B1

(12) United States Patent
Thompson

(10) Patent No.: US 10,709,238 B1
(45) Date of Patent: Jul. 14, 2020

(54) SHELF SYSTEM IMPROVEMENTS

(71) Applicant: Richard Simon Thompson, Hagerstown, MD (US)

(72) Inventor: Richard Simon Thompson, Hagerstown, MD (US)

( * ) Notice: Subject to any disclaimer, the term of this patent is extended or adjusted under 35 U.S.C. 154(b) by 0 days.

(21) Appl. No.: 15/209,993

(22) Filed: Jul. 14, 2016

Related U.S. Application Data

(60) Provisional application No. 62/196,324, filed on Jul. 24, 2015.

(51) Int. Cl.
*A47B 47/04* (2006.01)
*A47B 96/02* (2006.01)
*A47B 96/06* (2006.01)

(52) U.S. Cl.
CPC ..... *A47B 47/047* (2013.01); *A47B 47/045* (2013.01); *A47B 96/021* (2013.01); *A47B 96/066* (2013.01)

(58) Field of Classification Search
CPC ... A47B 47/047; A47B 47/045; A47B 96/021; A47B 96/066; A47B 2097/033; A47B 87/0223; A47B 47/00; A47B 87/02; A47B 47/0091
USPC .... 211/187, 188, 186, 119.003, 183, 106.01, 211/134; 108/26, 28, 30; 248/690, 692, 248/339, 301, 305
See application file for complete search history.

(56) References Cited

U.S. PATENT DOCUMENTS 163,852 A * 6/1875 Denman ..... A47B 61/00 108/30
D20,487 S * 1/1891 McBride ..... D7/555
449,134 A * 3/1891 Porter ..... A47B 61/00 108/135
806,893 A * 12/1905 Holder ..... A47B 61/00 108/149
976,639 A * 11/1910 Cots ..... A47B 17/02 108/3
1,140,940 A * 5/1915 Bates ..... A47B 57/42 211/87.01
1,188,227 A * 6/1916 Woods ..... A47G 1/1686 211/106.01
1,856,847 A * 5/1932 Gates ..... A47G 29/083 211/106.01
1,919,382 A * 7/1933 Sherwood ..... G09F 3/20 40/495
2,081,763 A * 5/1937 Peterson ..... A47B 61/00 108/152
2,096,024 A * 10/1937 Anderson ..... A47B 96/022 108/30
2,103,106 A * 12/1937 Yurkovitch ..... A47B 57/42 211/189
2,441,721 A * 5/1948 Schroeder ..... A47B 96/027 108/102
2,473,086 A * 6/1949 Gonzalez ..... A47G 29/083 211/86.01

(Continued)

*Primary Examiner* — Jonathan Liu
*Assistant Examiner* — Devin K Barnett
(74) *Attorney, Agent, or Firm* — Stephen J. Stark; Miller & Martin PLLC

(57) ABSTRACT

An improved shelf system often has differently configured shelves, at least some of which may receive attachments along a perimeter portions thereof. Those or others can provide bins for storing material as well internal to the shelves or along the perimeter portions.

12 Claims, 14 Drawing Sheets

(56) References Cited

U.S. PATENT DOCUMENTS 2,580,961 A * 1/1952 Schmedinghoff ..... A47K 1/09 211/113
2,614,702 A * 10/1952 Riblet ..... A47G 25/06 108/30
2,724,509 A * 11/1955 Youngberg ..... A47G 25/0678 108/102
2,732,159 A * 1/1956 Connors ..... A47K 10/10 222/180
2,837,219 A * 6/1958 Ferdinand ..... A47B 57/485 108/185
2,947,423 A * 8/1960 Ekstrom ..... A47G 25/06 108/30
2,984,346 A * 5/1961 Holley ..... B65D 75/327 220/23.4
3,016,638 A * 1/1962 Singer ..... G09F 3/202 40/5
3,191,777 A * 6/1965 Willits, Jr. ..... A47F 5/0815 211/106.01
3,240,463 A * 3/1966 Cook ..... A47G 29/083 248/215
3,279,620 A * 10/1966 Nesbitt ..... A47F 5/0853 211/106.01
3,313,509 A * 4/1967 Lockert ..... A47B 57/56 248/222.52
3,358,847 A * 12/1967 Magnuson ..... A47B 96/028 211/186
3,474,993 A * 10/1969 Murcott ..... A61H 3/00 108/28
3,516,634 A * 6/1970 Schafernak ..... A47B 96/061 211/106.01
3,579,710 A * 5/1971 Gartzke ..... A47B 57/26 16/93 R
3,599,918 A * 8/1971 Patchett ..... F21V 21/088 248/215
3,772,742 A * 11/1973 Gigante ..... A45D 27/00 248/229.16
D229,870 S * 1/1974 Czarny ..... 248/215
3,815,519 A * 6/1974 Meyer ..... A47B 57/585 108/61
4,033,396 A * 7/1977 Thomasset ..... A47H 1/00 160/184
4,228,905 A * 10/1980 Cammarota ..... A47B 81/04 108/28
D259,189 S * 5/1981 Wilson ..... D34/38
4,304,382 A * 12/1981 Jelen ..... B25H 3/04 211/89.01
4,382,416 A * 5/1983 Kellogg-Smith ..... E06C 9/04 114/363
4,389,133 A * 6/1983 Oberst ..... A47B 47/06 220/532
D286,964 S * 12/1986 Gecchelin ..... 108/30
4,697,712 A * 10/1987 Valiulis ..... A47F 5/01 108/107
D293,767 S * 1/1988 Powers ..... D7/553.3
4,724,968 A * 2/1988 Wombacher ..... A47F 5/005 211/184
D300,882 S * 5/1989 Olson ..... D3/328
4,989,815 A * 2/1991 McAuley ..... A47F 5/0846 211/59.1
5,026,016 A * 6/1991 Lisowski ..... H04R 1/08 248/225.11
5,078,279 A * 1/1992 Hancock ..... A47B 81/005 211/64
5,080,238 A * 1/1992 Hochman ..... A47F 5/0869 211/106.01
5,176,347 A * 1/1993 Rouail ..... A45D 20/12 248/206.2
5,259,520 A * 11/1993 Roggio ..... A47H 1/04 16/94 D
5,356,038 A * 10/1994 Banks ..... B65D 35/40 222/105
5,356,104 A * 10/1994 Rosenberg ..... A47F 5/0846 248/223.41
D352,203 S * 11/1994 Campbell ..... D7/546
5,433,416 A * 7/1995 Johnson ..... B65D 23/003 248/475.1
5,435,511 A * 7/1995 Hsu ..... A01K 63/006 248/206.3
5,441,707 A * 8/1995 Lewis ..... A61L 2/06 422/300
5,531,415 A * 7/1996 Kallemeyn ..... B25H 3/04 211/59.1
5,594,419 A * 1/1997 Lo ..... G08B 13/1472 248/339
D379,301 S * 5/1997 Lippincott ..... D9/424
5,653,348 A * 8/1997 MacDonald ..... A47F 5/0807 211/87.01
D383,943 S * 9/1997 Boley ..... D7/353
5,709,158 A * 1/1998 Wareheim ..... A47B 87/0246 108/180
5,720,398 A * 2/1998 Kump ..... A47F 5/0068 211/113
5,743,416 A * 4/1998 Yemini ..... B25H 3/04 211/70.6
5,904,263 A * 5/1999 St. Pierre ..... B65D 1/30 220/23.4
5,908,119 A * 6/1999 Kump ..... A47F 5/0068 211/113
5,915,572 A * 6/1999 Hancock ..... A47B 81/005 211/64
5,947,036 A * 9/1999 Cohen ..... A47B 49/004 108/110
5,979,675 A * 11/1999 Moriarty ..... B01L 9/54 211/119.003
D417,785 S * 12/1999 Daniels ..... D3/313
6,015,053 A * 1/2000 Sheng ..... A47B 88/0407 108/143
D429,899 S * 8/2000 Schwartz ..... D3/328
6,098,748 A * 8/2000 Harper, Jr. ..... B25H 3/02 182/129
6,124,019 A * 9/2000 Mense ..... A47C 31/023 297/228.13
D432,409 S * 10/2000 Feldmeier ..... D9/737
D435,382 S * 12/2000 Sorensen ..... D6/574
6,357,608 B1 * 3/2002 Timm ..... A47B 57/10 108/152
D455,065 S * 4/2002 Berg ..... D8/371
6,401,862 B1 * 6/2002 Caron ..... E06C 7/14 182/120
6,402,104 B1 * 6/2002 Smith ..... A47K 1/09 248/205.5
D463,977 S * 10/2002 Castellanos ..... D9/425
6,481,583 B1 * 11/2002 Black ..... A47F 5/0815 211/70.6
D466,758 S * 12/2002 Bradley ..... 220/23.8
6,578,720 B1 * 6/2003 Wang ..... A47F 5/0093 211/126.15
6,604,473 B2 * 8/2003 Felsenthal ..... A47B 77/10 108/107
6,637,707 B1 * 10/2003 Gates ..... A47B 81/005 211/64
D487,193 S * 3/2004 Liu ..... D3/313
D492,195 S * 6/2004 Shabaz ..... D9/737
6,877,826 B2 * 4/2005 Wood ..... A47B 45/00 108/110
6,938,784 B2 * 9/2005 Yang ..... A47B 88/00 211/87.01
7,093,726 B1 * 8/2006 Holztrager ..... A47F 5/0846 211/153
7,172,164 B2 * 2/2007 Fuelling ..... A01K 97/10 248/309.1
7,213,362 B1 * 5/2007 Weber ..... A01K 97/10 248/530
7,270,307 B2 * 9/2007 Zodnik ..... E06C 7/14 248/238
7,296,697 B2 * 11/2007 Costa ..... A47B 47/022 211/175

(56) References Cited

U.S. PATENT DOCUMENTS

D567,070 S * 4/2008 George ..... D8/371
D568,687 S * 5/2008 Lovett ..... D7/553.3
7,497,533 B2 * 3/2009 Remmers ..... A47B 57/42 108/108
7,516,929 B2 * 4/2009 Brustein ..... A47G 29/083 248/304
7,798,336 B2 * 9/2010 Shiao ..... B25H 3/04 211/70.6
D628,386 S * 12/2010 Kohn ..... D3/313
7,900,783 B2 * 3/2011 Fernandez ..... A47B 45/00 108/108
8,245,650 B1 * 8/2012 McKsymick ..... A47B 3/10 108/25
8,272,478 B2 * 9/2012 Astor ..... E06C 7/14 182/129
8,371,546 B2 * 2/2013 Bauerly ..... A47G 29/083 24/265 H
8,376,156 B2 * 2/2013 Jarvis ..... A47B 47/045 108/147.12
8,453,796 B2 * 6/2013 Astor ..... E06C 7/14 182/119
8,480,045 B2 * 7/2013 Adams, IV ..... F16B 45/00 248/205.5
8,573,412 B2 * 11/2013 Schwartz ..... A47F 5/0068 211/119.003
8,636,153 B1 * 1/2014 Dattilo ..... A47B 96/027 211/85.7
8,646,624 B2 * 2/2014 Fernandez ..... A47B 45/00 108/108
8,667,765 B1 * 3/2014 McCarthy ..... F16B 15/02 248/301
8,763,819 B2 * 7/2014 Theisen ..... A47F 5/0025 211/119.003
8,960,822 B1 * 2/2015 Hsu ..... A47B 96/00 312/334.4
9,022,237 B2 * 5/2015 Hall ..... A47J 47/16 211/162
9,204,737 B2 * 12/2015 Lamarre ..... A47B 47/0083
9,226,577 B2 * 1/2016 Stepp ..... A47B 81/005
9,386,865 B2 * 7/2016 Bally ..... A47F 3/14
9,586,803 B1 * 3/2017 Snyker
9,603,468 B2 * 3/2017 Nilsson ..... A47B 96/067
2001/0047970 A1 * 12/2001 McBride ..... A47B 87/008 211/85.11
2002/0000418 A1 * 1/2002 Miller, Jr. ..... A47F 5/0018 211/188
2002/0092818 A1 * 7/2002 Craft ..... A47B 96/021 211/188
2003/0214798 A1 * 11/2003 Shirakami ..... H05K 7/1409 361/796
2005/0103733 A1 * 5/2005 Saltzberg ..... A47B 57/50 211/187
2005/0103734 A1 * 5/2005 Saltzberg ..... A47B 57/50 211/187
2005/0150850 A1 * 7/2005 Stitchick ..... A47B 47/022 211/90.03
2005/0166738 A1 * 8/2005 Hsu ..... B26D 7/015 83/614
2005/0224435 A1 * 10/2005 Alter ..... A47B 47/028 211/153
2006/0060746 A1 * 3/2006 Hsu ..... A47B 97/08 248/444
2006/0237875 A1 * 10/2006 Drees ..... B29C 45/1775 264/328.1
2006/0289714 A1 * 12/2006 Boklund-Moran ..... A47G 29/083 248/339
2007/0011926 A1 * 1/2007 Yniguez ..... G09F 15/00 40/606.1
2007/0017146 A1 * 1/2007 Glidewell ..... A01K 97/06 43/54.1
2007/0158517 A1 * 7/2007 King ..... A47F 5/0006 248/301
2007/0200042 A1 * 8/2007 Gschwend ..... G08B 13/1427 248/339
2007/0257175 A1 * 11/2007 Allen ..... A47G 25/0607 248/339
2007/0266910 A1 * 11/2007 Lux ..... B65D 19/0012 108/57.28
2008/0053940 A1 * 3/2008 Whalen ..... A47B 47/045 211/134
2008/0138477 A1 * 6/2008 Mular ..... A47J 47/10 426/392
2008/0246377 A1 * 10/2008 Huang ..... A47B 88/40 312/334.8
2009/0107939 A1 * 4/2009 Liao ..... A47F 5/10 211/134
2009/0108164 A1 * 4/2009 Washio ..... A47G 29/083 248/339
2010/0086839 A1 * 4/2010 Wu ..... G06F 1/1635 429/97
2010/0116698 A1 * 5/2010 Sudhakar ..... B65D 51/2821 206/219
2010/0307116 A1 * 12/2010 Fisher ..... B65D 51/28 53/492
2011/0258814 A1 * 10/2011 Ng ..... A47H 1/04 24/115 R
2012/0031864 A1 * 2/2012 Wasson ..... A47B 47/045 211/134
2012/0097626 A1 * 4/2012 Deguglimo ..... A47F 5/0068 211/59.2
2012/0305508 A1 * 12/2012 Brozak ..... A47F 7/0021 211/85.5
2013/0008865 A1 * 1/2013 Su ..... A47F 5/11 211/153
2014/0263137 A1 * 9/2014 Reinhart ..... A47B 96/1416 211/186
2014/0291266 A1 * 10/2014 Yang ..... A47B 96/00 211/126.15
2015/0173507 A1 * 6/2015 Cardon ..... A47B 23/06 108/26
2015/0313357 A1 * 11/2015 David ..... A47B 47/027 211/187
2015/0366408 A1 * 12/2015 Cohen ..... A47B 47/0075 211/85.12
2016/0007739 A1 * 1/2016 Shinozaki ..... A47B 57/545 211/187
2016/0259129 A1 * 9/2016 Geens ..... G02B 6/4455

* cited by examiner

SHELF SYSTEM IMPROVEMENTS

CLAIM OF PRIORITY

This application claims the benefit of U.S. Provisional Patent Application No. 62/196,324 filed Jul. 24, 2015, which is incorporated herein by reference in its entirety.

FIELD OF THE INVENTION

The present invention relates to shelf system improvements and more particularly, for at least some embodiments, to ventilated plastic shelving systems and components, often sold in a kit form having at least two different shelf constructions and/or at least some shelves which provide integrated bins and/or cooperate with attachments or side by side shelves along the edge thereof.

BACKGROUND OF THE INVENTION

Plastic shelving has been made for many years by many different companies. They are often sold in a kit form with either three, four or five shelves. The shelves are typically identical and sets of four supporting legs are provided for use intermediate each of the vertically disposed parallel shelves. The shelves when supported by the legs are vertically parallel to one another and secured at the four corners by the legs.

The shelves are usually injection molded and often have perforations and/or passages there through to allow air to circulate through the shelf so as to be mildew resistant or for other purposes. This classification of shelving is often referred to as ventilated shelving.

However, a drawback of having ventilated shelves is that items can drop through the perforations or passages through the shelves. Furthermore, organizing smaller items on these prior art shelves can be difficult as small items placed on the shelves may tend to potentially fall through the passages and/or perforations and/or alternatively, if loosely placed upon the shelves, they may not easily be separated from one another.

Finally, there is typically no system known to the applicant in prior art shelf systems to have connecting attachments (or side by side connection of shelves) configured to cooperatively connect thereto such attachments as bins, hooks, cable wraps and/or other attachments.

Accordingly, there is a perceived need for an improved shelf and/or shelf system having at least one of the improvements disclosed herein.

SUMMARY OF THE INVENTION

It is an object of many embodiments of the present invention to provide an improved shelf system having at least two differently configured shelves which are then provided as a kit to be assembled in parallel fashion with intermediate supporting legs.

It is another object of many embodiments of the present invention to provide an improved shelf for use with shelving systems having integral bins formed into at least some of the shelves for storing articles in a separated manner, internal to the shelf.

It is another object of many embodiments of the present invention to provide a shelf for use with shelving system having attachment locations configured to connect to specifically designed attachments such as bin attachments, cord or cable wrap attachments, hook attachments and the like so that attachments can be connected to and/or at the edges of the shelf. In fact, for some embodiments, at least one, if not some, attachments may be provided in a kit form with the shelf. Possibly similar or dissimilar shelves may be provided in a kit form for the forming of a multi-level shelf system having legs supporting parallel disposed shelves in such kits.

It is another object of many embodiments of the present invention to provide an improved injection molded shelves for use with a shelf system. Such shelves may have an edge receivers for use with at least certain attachments so that attachments such as bins, cable or cord wraps or hooks can be connected at selected locations about the edge or periphery of the shelf. For some embodiments, at least some of these attachments may be provided in a kit form with the shelving system.

It is yet another object of many embodiments of the present invention to provide leg attachments for use in connecting one shelf to another in side by side connection.

Accordingly, in accordance with the presently preferred embodiment of the present invention, a kit for a shelf system may be provided having at least two plastic injection molded shelves. For many embodiments, at least one of these shelves can be different from the other. Some embodiments may have two, three, four, five (or even more) shelves which are disposed vertically in relationship to one another in a parallel fashion, preferably with sets of four legs supporting each of the corners of each of the shelves intermediate adjacent shelves.

For many embodiments, at least two different shelf constructions are provided with the kit. Specifically, a first shelf may be provided which has integral bins formed into the shelf itself. Specifically, for one presently preferred embodiment there are six trays or bins which are molded into the shelves which are ventilated shelves (i.e., in that they have perforations or passages therethrough) possibly except for the bin portions which are configured to receive small parts or other items therein. These bins may be symmetrically disposed relative to a centerline of the shelf as extending from front and the back when in use for at least some embodiments. The bins also preferably extend downwardly relative to an upper surface of the shelf for at least some embodiments.

Other shelves may not have the bins and/or otherwise provide other bin configurations different from that of the first shelf configuration.

Additionally, at least one, if not some of the shelves preferably are provided with a plurality of edge receivers located at, near and/or on sides of the shelf as well as at least in front of the shelf, if not at a rear of the shelf as well. These edge receivers are configured to cooperate with attachments having connector portions configured to be selectively received in the receivers for adjacently disposing attachments such as cord wraps, bins, hooks or other attachments along, at, and/or to the shelf such as along the side of the shelves. When sold in a kit form, the attachments may be provided with the shelving system such as by being located internal to the bins of the bin shelf configuration when sold which is a particularly attractive option for packaging such systems in a compact arrangement.

Attachments such as hooks can be received within any of at least one, if not a plurality of receivers, so one or more hooks could be provided along either of the sides and/or front (or back) of the shelves. A top of the attachment connector preferably sits at least substantially flush with a top of the receiver (or below) when installed, and for many embodiments the attachment connector is easily removed from the receiver. At least one if not two similar attachment connectors can be disposed on an attachment such as a long or a wider bin for use at either the front and/or sides. Furthermore, a cord wrap could be provided for use on the sides and/or front and those attachments may have one, if not two attached connector portions connected thereto.

When two receiver connector portions are provided on a single attachment, they are preferably spaced apart and are preferably received in two spaced apart receivers on the shelf which are preferably constructed with the desired spacing to be able to receive these connector portions. Connector portions preferably are received substantially or completely within the receivers and may even friction fit to at least to some extent for many embodiments. The receivers may have open bottoms to assist the user may have to remove an attachment such as by being able to push an item through the hole (such as a screwdriver to dislodge the attachment connector therefrom). Furthermore, the receivers preferably include a slot which extends through the side wall of the shelf for many embodiments. In fact, the slot may be a narrower width than a receiver slot body internal to the shelf itself. Similarly, the connector portion may have a wider foot than a neck. The neck may then extend through the slot in the side of the shelf wall for at least some embodiments with the foot being received in the slot body.

Bins may take various constructions. Hooks may be configured to be able to cooperate with various items. Furthermore, the cord wrap could take various configurations and preferably be configured to be able to hold an extension cord or other cord thereon. Two cord wraps could be provided onto adjacent shelves, one in an upward and one in a downward configuration to wind the cord thereabout as a possible embodiment which may be desirable for some embodiments. Otherwise one cord could be provided as one above another below. Shelves may be constructed with leg attachments to provide an ability to assist in attaching to adjacently disposed shelves such as two similar shelving units in a side-by-side arrangement so that by connecting together side-by-side units, a more stable construction can be provided. Each of the shelves could be constructed either to have a solid center portion or have an internal bar for structural support for various embodiments.

As those of ordinary skill in the art will see, the various features of the applicant's shelf system and shelves, and attachments is believed to be novel over prior art constructions with features not previously seen in the shelving industry either as a shelving system, a shelving system with improved shelves and/or attachments for use with shelves.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
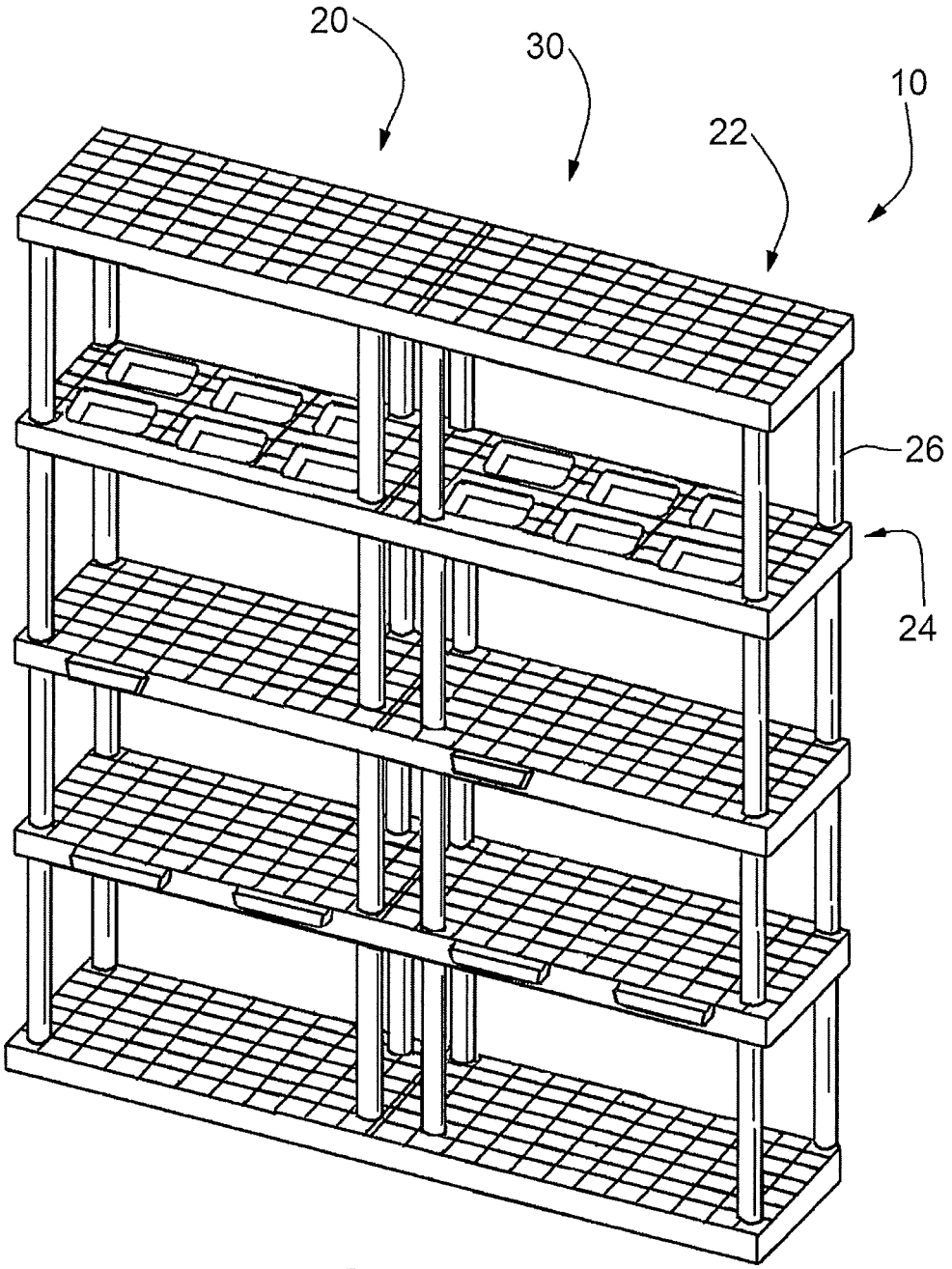
FIG. 1 is a front perspective view of the presently preferred embodiment of the present invention.

FIG. 1 shows at least one, if not two, shelf systems 10 in a connected configuration as shown. It would be understood that the shelf system 10 is comprised of shelving systems 20 and 30 preferably in a connected manner as will be discussed in further detail below. The shelving systems 20 and 30 are preferably sold as kits (in boxes) comprising the shelves which may include some of both a) a first shelf configuration 22 and a second shelf configuration 24 which are preferably provided in a single box as a kit possibly with multiple ones of either first or second shelf configurations 22,24. The illustrated embodiment has four first shelf configurations 22 and a single second shelf configuration 24. Leg sets would normally be included in such kits as well. Other embodiments could have multiple second shelf configurations 24 and possibly only a single first shelf configuration 22 depending on the objectives. Furthermore, as one of ordinary skill in the art would understand, third, fourth, fifth shelf configuration(s) (not shown) could be used with various shelving kits as well. When provided as a kit such as system 20 and/or 30, at least one and/or second shelf configurations 22,24 are preferably provided with at least two shelves selected from the group of first and second shelf configurations 22,24 along with sets of four legs 26 for each shelf provided over one. Specifically, when only two shelves are provided, four legs 26 are provided. If three shelves are provided, eight legs 26 would be provided. If four shelves were provided, twelve legs 26 would be provided, etc. Furthermore, the various attachments shown in FIGS. 1 and 7-11 as will be described in further detail below could also be provided for at least some embodiments. Normally in these shelf systems 20 and/or 30, the first and second shelf configurations 22,24 may be provided in a stacked manner in a box (not shown) along with the legs. The accessories provided with the kit, if any, can be provided also in a somewhat nested manner for at least some embodiments as will be described below.

Figure 2:
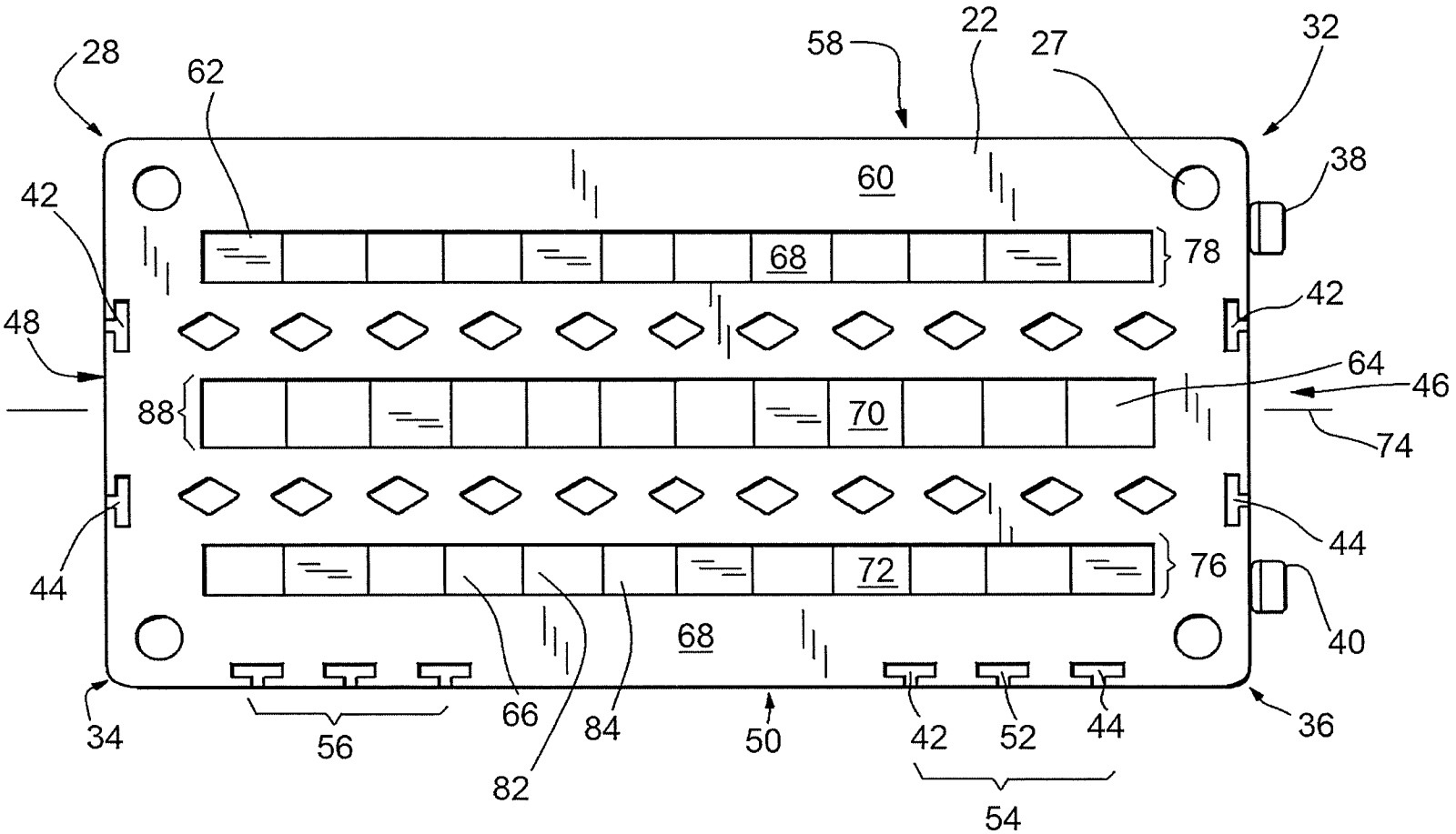
FIG. 2 is a top plan view of one of the shelves shown in the embodiment of FIG. 1.

FIG. 2 shows a top plan view of a first shelf configuration 22. First shelf configuration 22 has leg receivers 26 disposed at the respective corners 28,32,34,36 of the first shelf configuration 22. Additionally, first and/or second attachment legs 38,40 are useful for connecting adjacent shelves such as first and second shelf configurations 20, 30, together, as will be explained in further detail below.

The first shelf configuration 22 also preferably has at least one receiver 42 if not a plurality of first receiver(s) 42 such as first and second receivers 42,44 located on the right side 46 of the first shelf configuration 22 which is opposite the left side 48. The left side 48 can also have first and second receivers 42,44 and/or other receiver configurations as would be understood by those of ordinary skill in the art. In fact, disposed towards the front 50 first, second and third receivers 42,44,52 are provided in first, second and third receivers 42,44,52 as a first set 54 along with a second set 56 for use in accepting various attachments as will be explained in further detail below. Other receiver configurations and/or set constructions could be provided along sides 46,48, the front 50, and/or back 58 for various embodiments. Other embodiments may have third receivers 52 provided on the right and left sides 46,48 as would be understood by those of ordinary skill in the art. Still, additional receivers 42,44,52 may be provided in different locations along the sides 46,48, front 50 as well as the back 58 for various embodiments. Normally, the back 58 would be against a wall, but other embodiments can be provided with receivers 42,44,52 at various locations along the back 58 as well. More about the receiver construction will be described below.

The first shelf construction 22 preferably has an upper surface 60 from which first, second and third bar channels 62,64,66 downwardly depend therefrom. The bar channels 62-66 preferably do not extend below a bottom of the shelf construction 22. Furthermore, perforations or passages such as 68 preferably extend through the upper surface 60 and the first-shelf construction 22. The bar channel 62,64,66 preferably extend downwardly to bottom surfaces 68,70,72 which is a bottom of the first, second and third bar channel 62,64,66. The bottom surface 68,70,72 could be disposed in a coplanar relationship or otherwise for various embodiments. Furthermore, the first, second and third bar channels 60,64,68 may, or may not, be the same length as can be seen from the embodiment. The first and third bar channels 62,66 are disposed symmetrically relative to front to back centerline 74 but could be provided differently for various embodiments. The first and third bar channels 60,68 can also have the same width 76,78 or not. The width 80 of the center bar channel, if utilized, could be slightly wider than the width of the first and third bar channel 62,66 or not. Furthermore, the center bar channel 64, if utilized, can also be symmetrically disposed relative to centerline 74 of the first shelf construction 22 for at least some embodiments.

The first and second shelf passages 68,70 are shown as being having a similar perimeter but other perimeters of various passages 68,70 and/or numbers of passages 68,70 could be provided for various embodiments. Passage 68,70 may allow for the flow of air through the first shelf configuration 22 to provide a ventilated shelf which is believed to assist in reducing the likelihood of mildewing items on the shelf of first shelf construction 22 when provided in the form shown in FIG. 1 or others. Other means of providing ventilation could be provided with other embodiments. The first, second and third bar channels 62,64,68 can also be provided with dividers 82 to provide compartments 84 there along for various uses, if provided, such as storing nails. Dividers 82 may also be utilized to provide structural support for the first shelf configuration 22.

Figure 3:
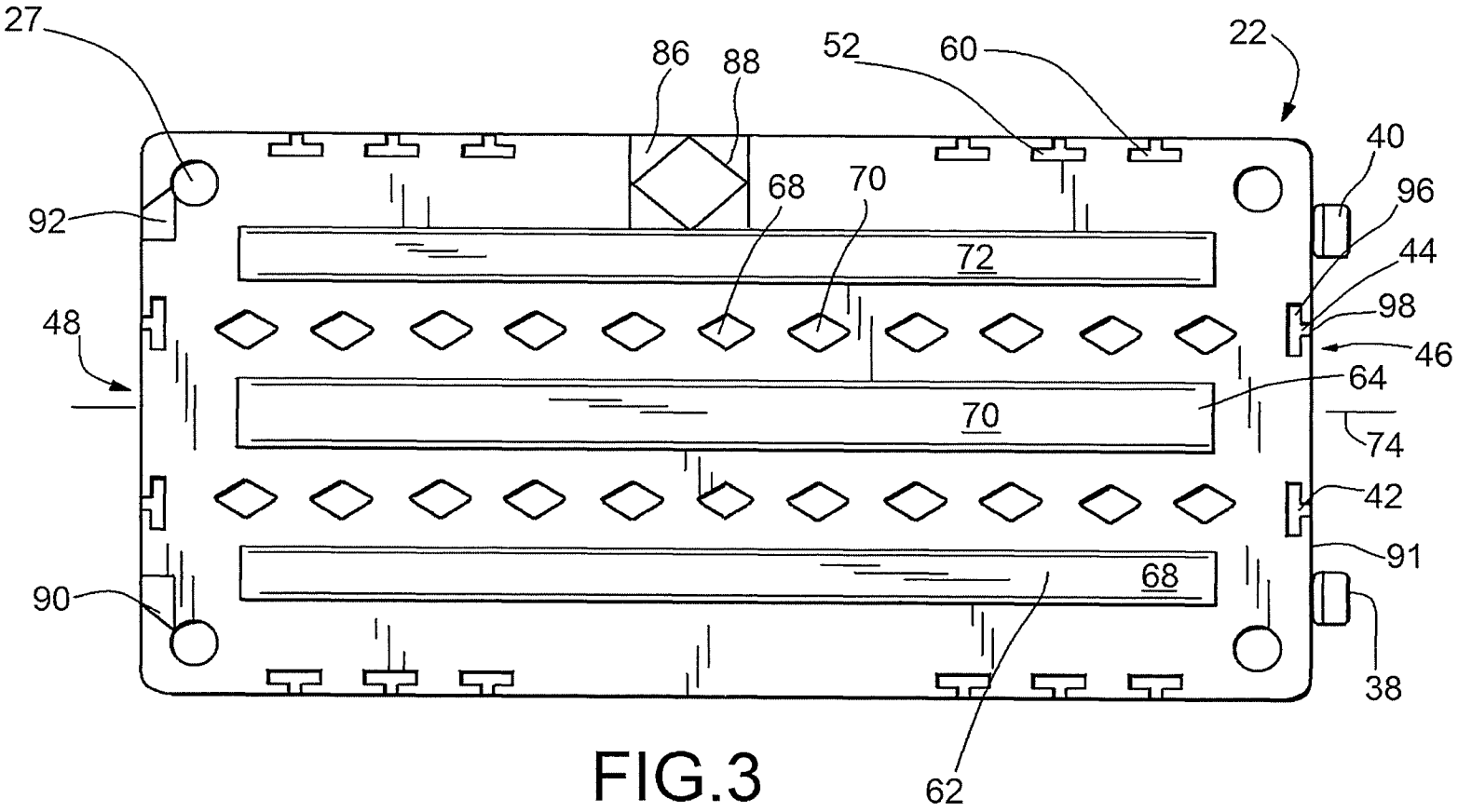
FIG. 3 is a bottom plan view of the shelf shown in FIG. 2.

FIG. 3 shows a bottom view of the first shelf configuration 22 with a bottom surface 68,72 of the first, second and third bar channels 62,64,66 being shown (also being coplanar) and potentially at above a bottom of side wall 91. The passages 68,70 are also clearly shown passing through the first shelf configuration 22. Furthermore, structural support such as bracings 86 are shown in a perpendicular manner relative to the bar channels 62,64,66. Angular bracings 86 can also be utilized as understood by those of ordinary skill in the art as well as parallel bracings. Additionally, bracings such as those shown about the leg bores 26 could be used which are illustrated extending somewhat radially and/or otherwise from the leg bores 26 to potentially provide additional structural support for the first shelf configuration 22.

The attachment legs 38,40 as shown could be received within an adjacent first and/or second shelf construction 22,24 such as in leg receivers 90,92 as would be understood by those of ordinary skill in the art to potentially provide side by side support and/or adjacent connection of a right side 46 of a first shelf configuration 22 with a left side 48 of a second first shelf configuration 22 as shown in FIG. 1. The first and second leg attachments 38,40 are preferably integrally connected, if not molded together with the construction of the first shelf configuration 22 to extend outwardly away from a side wall 248 of the perimeter of the first shelf construction. The second shelf construction 24 may or may not be similarly constructed. With the side by side first shelf configurations 22 connected together as shown in FIG. 1, the first and second leg attachments 38,40 are received within the first and second leg receivers 90,92 so that the upper surfaces 60 of adjacent first and/or second shelf configurations 22,24 may be coplanar as are the entire first shelf configurations 22. Furthermore, although first and second shelf configurations 22 are shown connected together but could be understood that a first shelf configuration 22 could be similarly connected to a second shelf configuration 24 will be explained in further detail below, but would be understood by those of ordinary skill in the art.

The first, second and third receivers 42,44,52 preferably have first receiver passage 96 as well as second receiver passage 98 which both may or may not extend through the upper surface 60 shown in FIG. 1 as well as completely through the first shelf configuration 22 so that an attachment might be removed when stuck by pushing through the first and/or second receiver passages 96 and/or 98.

Figure 4:
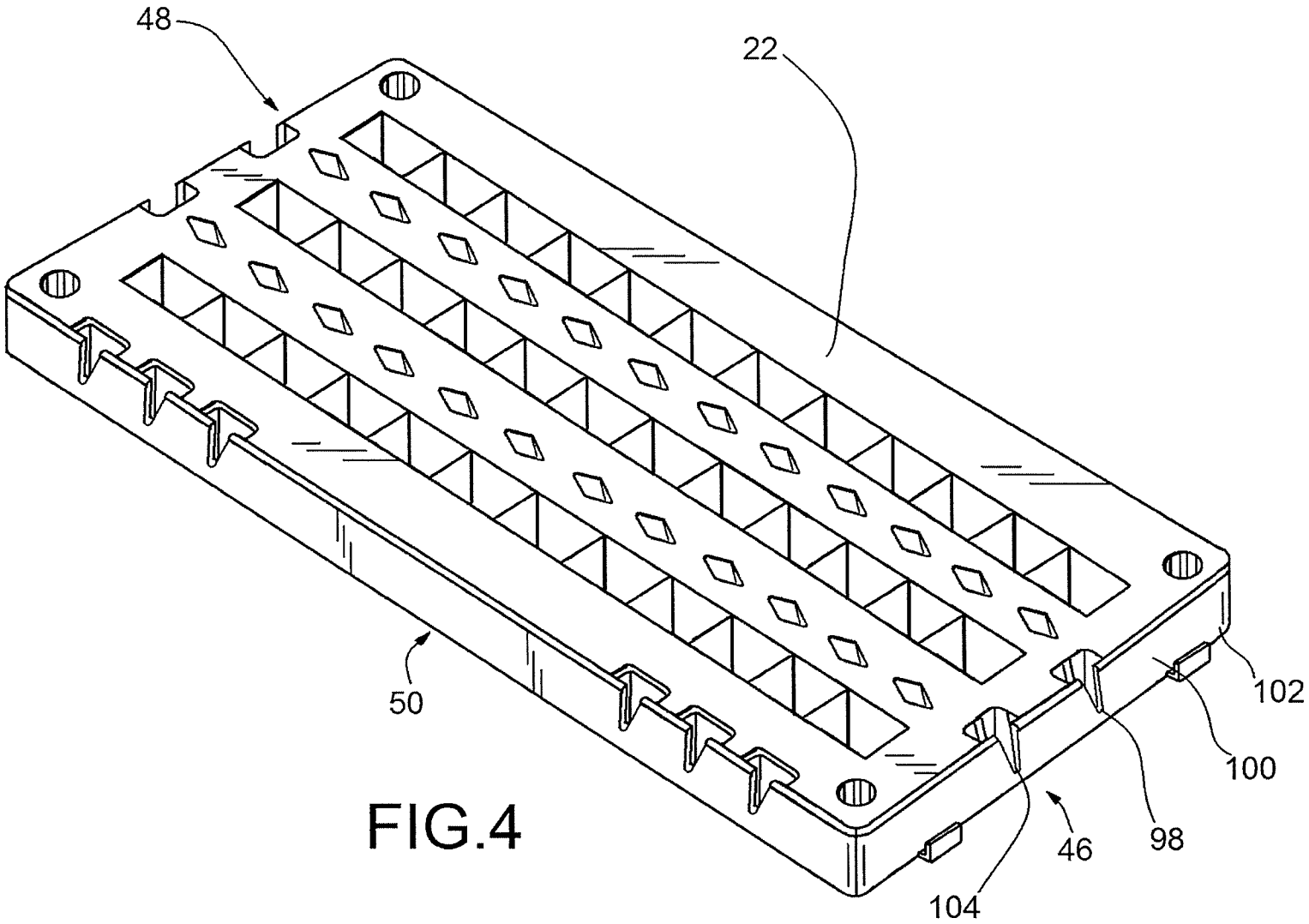
FIG. 4 is a top perspective view of the shelf in FIGS. 2 and 3.

FIG. 4 shows a perspective view of the first shelf configuration 22. In this view, the second receiver passage 98 is shown better as being possibly being a part of slot 100 in that slot 100 does not preferably pass all the way through the perimeter wall 102 (side wall) whether it be at the right side 46 or left side 48 or front side 50, or even the back 58. In fact, slot bottom 106 may be provided with the slots 100 to assist in supporting an accessory connector as will be discussed in further detail below. The receivers 42,44 could also have other portions which support a connector as will be discussed in further detail below.

Figure 5:
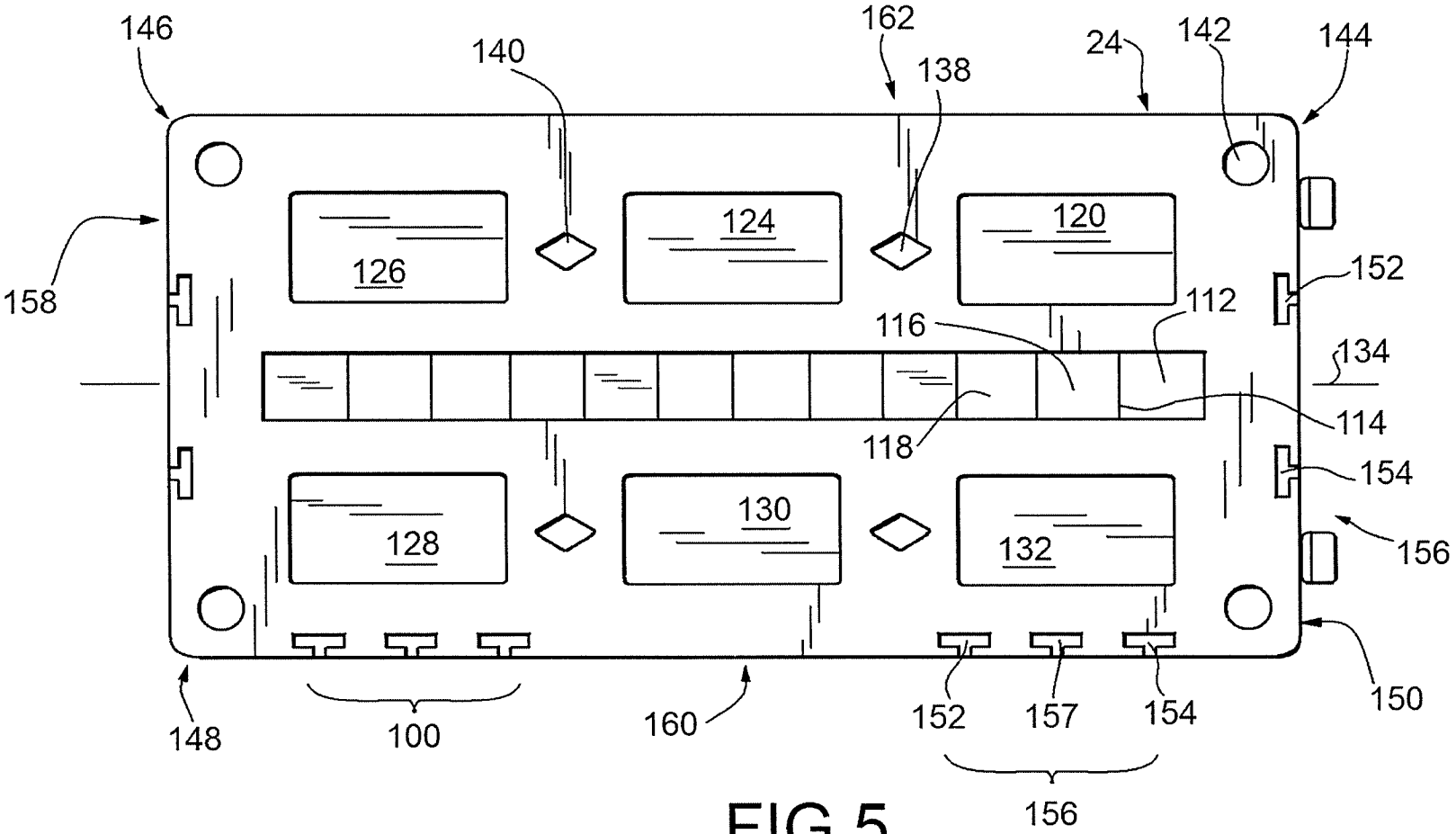
FIG. 5 is a top plan view of a second shelf shown in FIG. 1.

FIG. 5 shows the second shelf configuration 24 of a presently preferred embodiment. This second shelf configuration 24 also has an upper surface 110 defining a perimeter about sides 156,158 front 160 and back 162 and an optional central bar channel 112 which could be similarly or dissimilarly constructed as with the first shelf configuration 22. Dividers 114 are shown separating into compartments 116 for at least some compartments and/or for structural stability and the bar channel 112 also has a bottom 118 which could be coplanar or not coplanar with bottoms such as 120 of the bins 122,124,126,128,130,132. Bins 122-132 are shown symmetrically disposed relative to centerline 134 of the second shelf configuration 24 for at least some embodiments. The bins are also sufficiently sized so that certain accessories as will be described in further detail below might be included within the various bins 122-132 and provided as a kit of shelf system(s) 20, and/or 30. The second tray configuration 24 may still be adjacently disposed with a bottom such as bottom 136 in contact with upper surface 110 or with bottom 136 in contact with upper surface 60 of a first tray configuration 22 when provided in kit form with the accessories stored within any of the bins 122-132.

Perforations or passages 138,140, etc. may be provided so that the second shelf configuration 24 may be a ventilated shelf for at least some embodiments. Bins 122-132 may be shorter than a length of the bar channel 112 and in fact, all three of the bins 122-132 do not comprise the total length of the bar channel 112 for at least some embodiments.

The bins 122-132 can be configured to hold various components therein or assist in preventing things from sliding across the top or upper surface 110 of the second tray configuration 24. The first, second and third bins 122-126 can be symmetrically disposed relative to centerline 134 relative to the fourth, fifth and sixth trays or bins 128,130, 132 as would be understood by those of ordinary skill in the art or otherwise provided in various embodiments.

Bins 122-156 preferably extend downwardly from upper surface 110 but not below side well bottom 136 (may be to it for some embodiments).

This second tray configuration 24 also may have leg bores 142 at the edges 144,146,148,150 as would be understood by those of ordinary skill in the art with the legs 26 either connecting to other legs 26 through the leg bores 142 and/or with the leg bores 142 in a similar or dissimilar manner as with the leg bores 27 of the first shelf configuration.

Additionally, the second shelf configuration 24 is shown having first and second leg receivers 152,154 along the right side 156. Another set can be similarly seen along the left side 158 as well as the front 160 and/or possibly even the back 162 for at least some embodiments. The front 160 is further shown having a third receiver 156, between the first and second receivers 152,156 in a first set 158, as well as a second set 160. Of course, the receivers on either of the sides 156,158 could also be provided in a similar and dissimilar manner with either or lacking any of the first, second or third receivers 154,156,158. Although there are only six receivers shown on the front and two on each side, any number of receivers (of one or more configurations) could be provided with various embodiments, on any of the sides 156 and 158 and/or front 160 and/or back 162.

Figure 6:
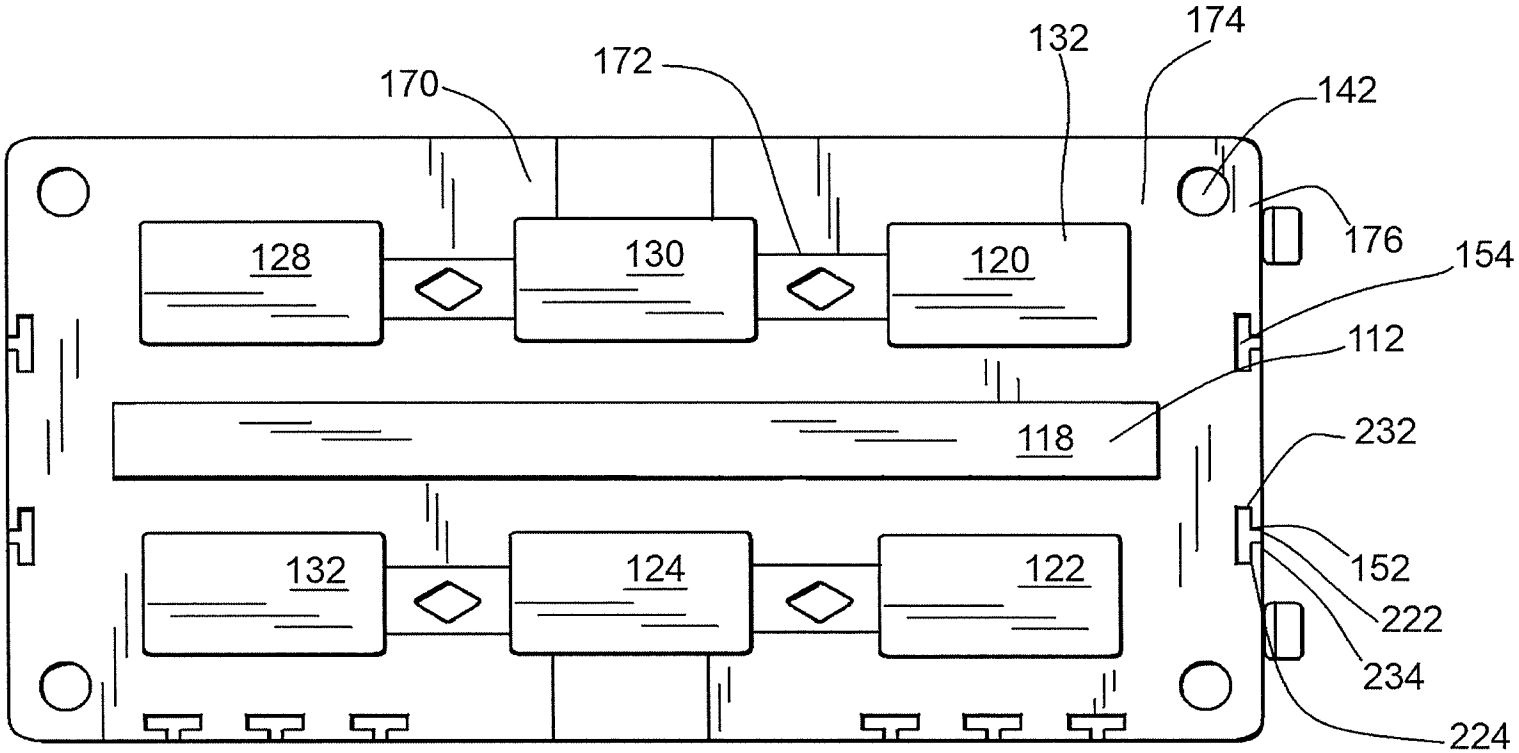
FIG. 6 is a bottom plan view of the shelf shown in FIG. 5.

FIG. 6 shows the bins 122-132 having bottoms 120 being coplanar, possibly also coplanar with bottom 118 of the bar channel 112. Various bracings such as bracing 170 for perpendicularly provided bracing relative to the bins 122-132 can be provided, as well as the bar channels 112, as well as parallel bracings 172 and/or angular bracings 174. Furthermore, the leg bores 142 may also be provided with radial and/or various other bracings 176 as is shown in the figures.

The receivers, such as first and second receivers 154,152, 156 may be similarly or dissimilarly constructed as those on the first shelf construction 22, and are illustrated in a similar fashion.

Figure 7:
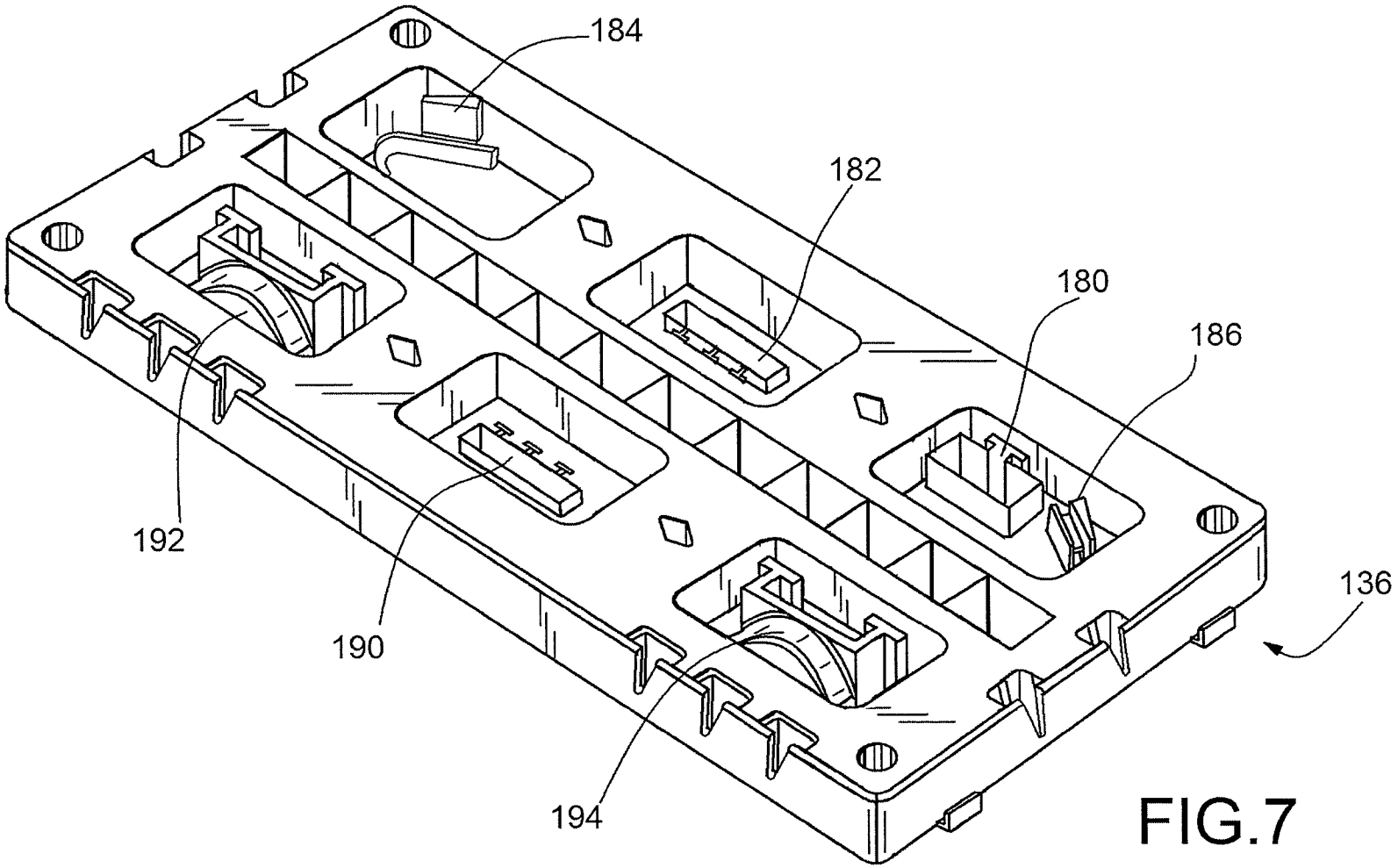
FIG. 7 is a top perspective view with attachments as they could be stored for shipping and as they are shown in FIG. 1 in an installed configuration.
Figure 8:
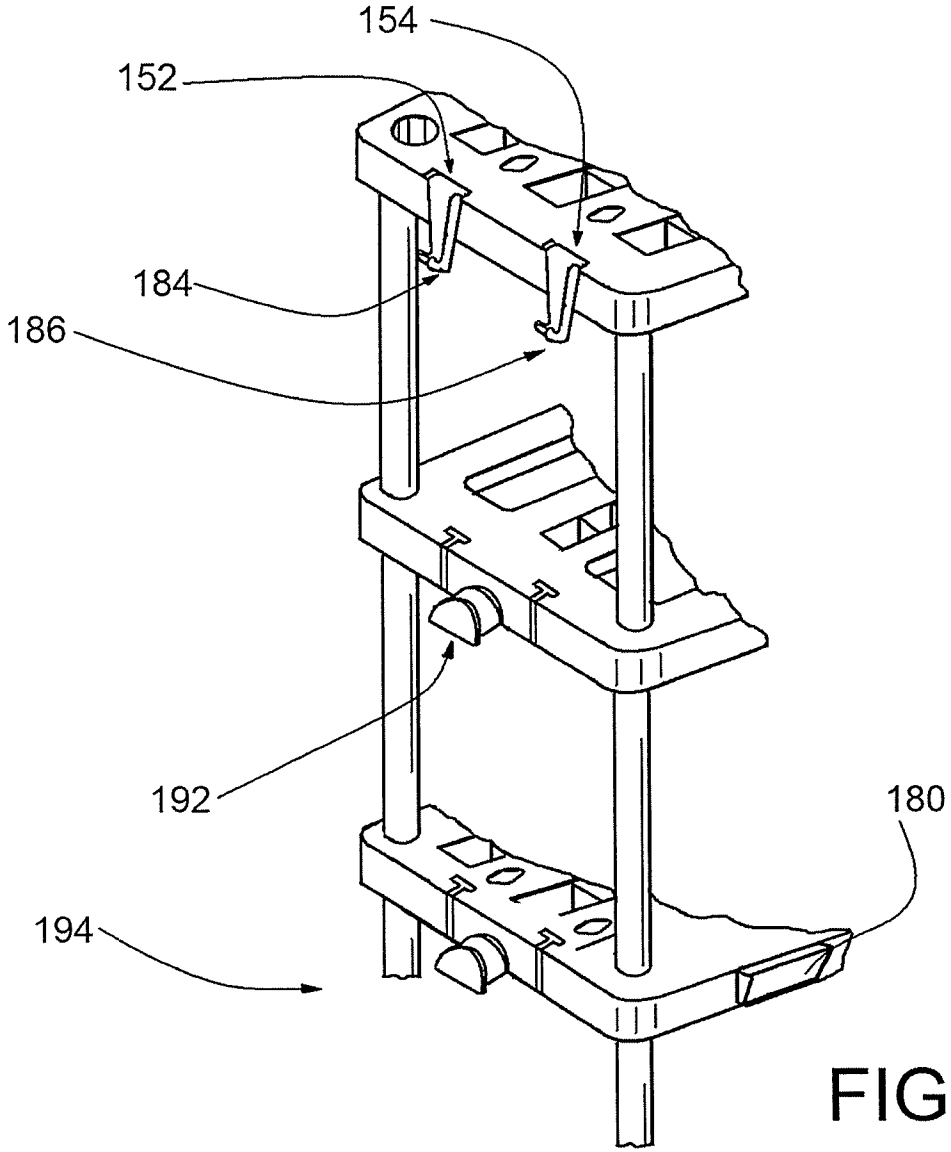
FIG. 8 is a close-up view of the left side of a first set of shelves shown in FIG. 1 with attachments connected thereto.

FIG. 7 shows various accessories contained within the bins for a storage configuration. Specifically, a first bin attachment 180 is shown. A second bin attachment 182 is also shown. First and second hooks 184,186 are shown. A second large bin 190 and first and second cord wraps 192 and 194 are also shown. These attachments 180-194 as shown installed in FIG. 1, as will be explained in further detail with reference to FIG. 8.

Specifically, first and second hooks 184 and 186 are shown connected to first and second receivers 152,154. Each of these will be discussed in greater detail with reference to FIG. 10. A first large bin such as 182 or 190 is shown connected in FIG. 11. A small bin such as bin 180 is shown connected in FIG. 8 and cord wraps such as first and second cord wraps 192 and 194 are shown connected in FIG. 8 and FIG. 9.

Figure 9:
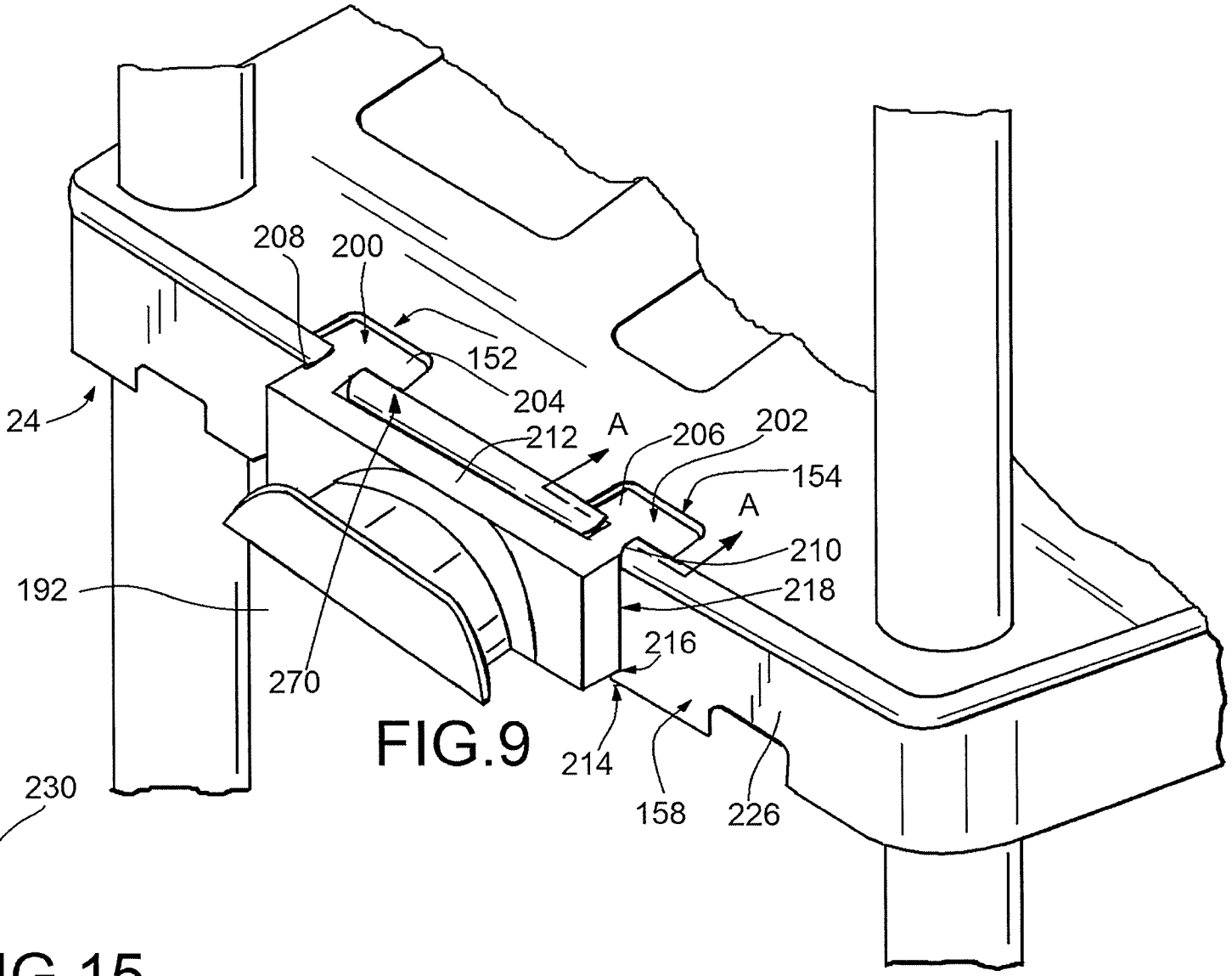
FIG. 9 is a close-up of the cord wrap attachment shown in an installed configuration similar to that shown in FIGS. 1 and 8 in an installed configuration as well as in a stored configuration in FIG. 7.
Figure 15:
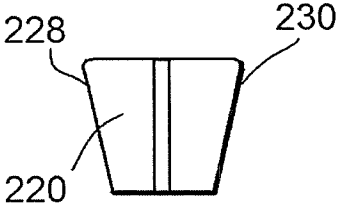
FIG. 15 is a cross sectional view taken along the line A-A in FIG. 9.

FIG. 9 shows the first cord wrap 192 with first and/or second connectors 200,202 received in first and/or second receivers 152,154. The connectors 200,202 preferably have bases 204,206 connected by necks 208,210 to shoulder 212 as shown being adjacent to and preferably or possibly in contact with left side 158 of the second shelf configuration 24. Of course, it could be the second side 48 of the first shelf configuration 22 for other embodiments.

As can be seen from FIG. 9, the bottoms 214 of the necks 206,208 can contact the bottoms of the slots. Sides 228,230 may not necessarily be vertically oriented, but could be angularly disposed to cooperate with oppositely-otherwise angled surfaces of receivers 154,157 to assist so that the sides 228, and/or 230 contact the sides 232,234 to assist in providing a friction fit and/or otherwise retaining the connectors in a desired configuration such as is shown in the figures.

Figure 10:
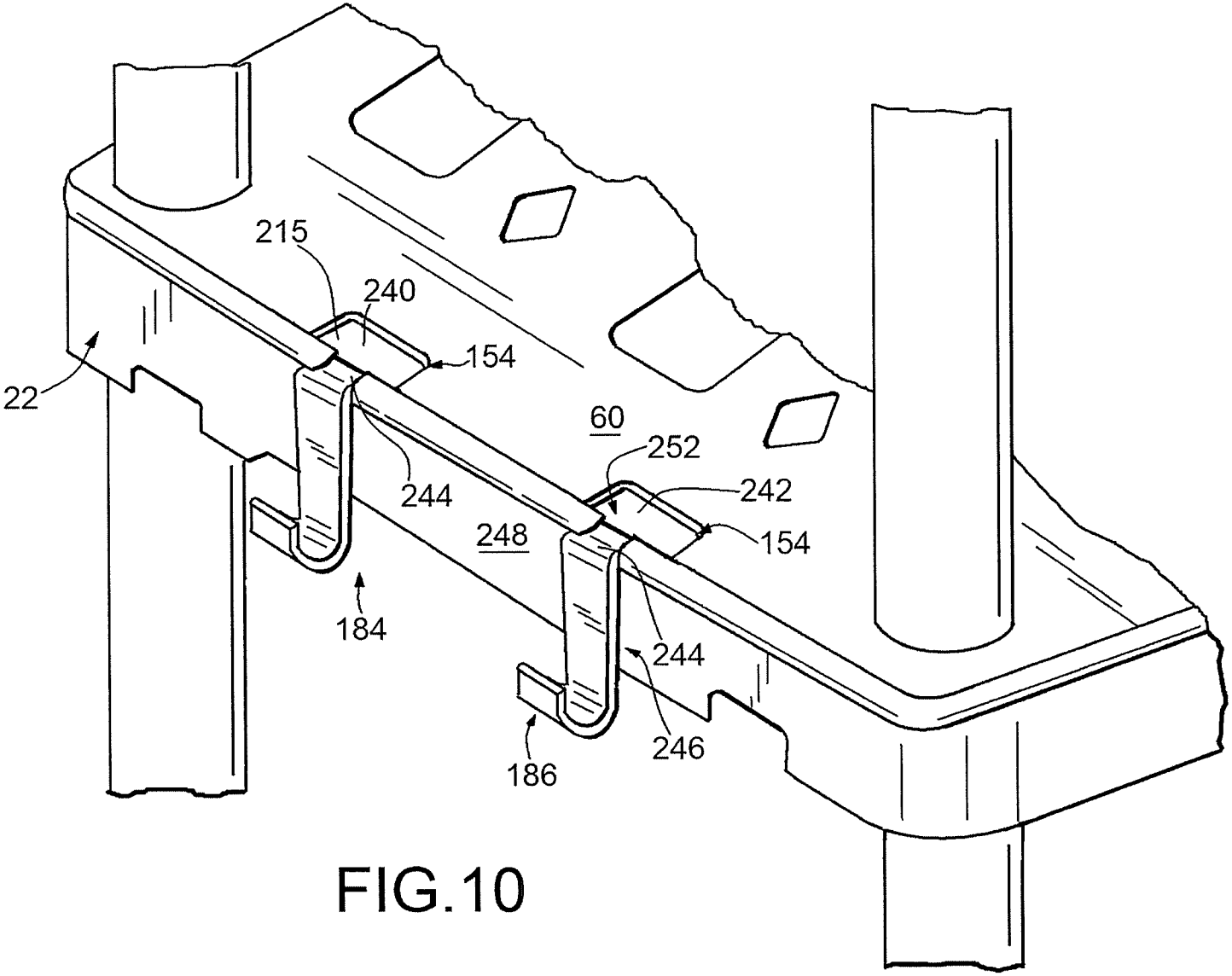
FIG. 10 is a close-up perspective view of the hooks installed to the shelf as the shelf in FIGS. 1 and 8 in an installed configuration as well as a storage configuration shown in FIG. 7.

FIG. 10 shows hooks 182,184,186 in receivers 192,191, 194. Notice that the top of the bases 240,242, as well as the necks 244 and 246 may be disposed below the upper surface 60 of the first shelf construction 22 for at least some embodiments in the installed configuration. Other embodiments may have the upper surfaces 240,244 parallel thereto. Hooks 184,186 preferably have a reverse face 246 which may contact side 248 of the first shelf construction 22 when installed to assist in stability. The connectors 250,252 may be similarly or dissimilarly constructed to the connectors of the cord wraps 192 shown in FIG. 9.

Figure 11:
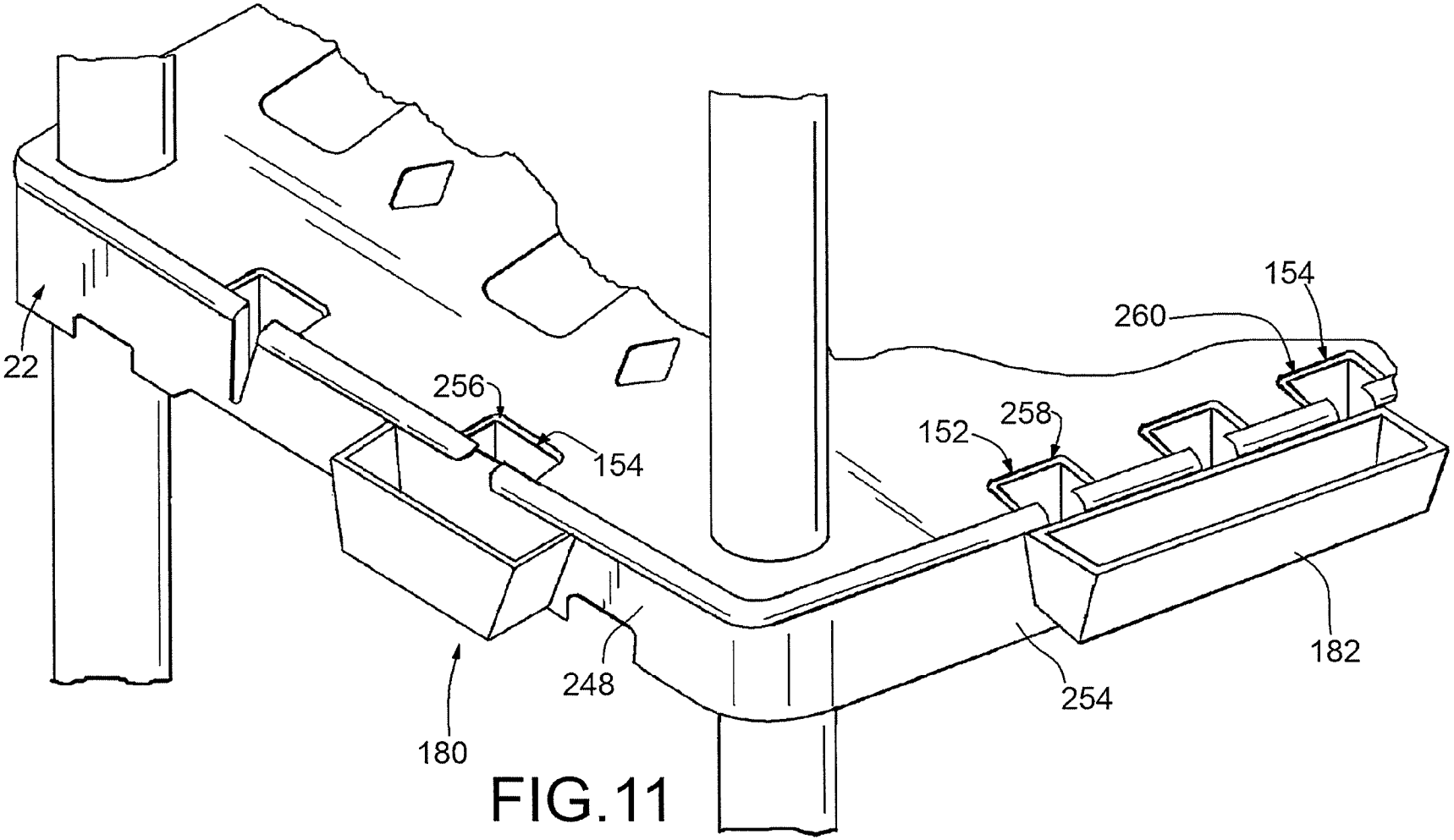
FIG. 11 is a top perspective view of the bins shown in FIGS. 1 and 8 in an installed configuration as well as a stored configuration shown in FIG. 7.

FIG. 11 shows a small bin 180 and a large bin 182 connected to one of the sides 248 and one to the front 254 in what appears to be a first shelf construction 22. Once again, the connectors 256 and 258 and 260 may be similarly or dissimilarly constructed and retained to the receivers as is shown and described with reference to the cable wraps. The difference between the small bin 180 and the large bin 182 is that there is a single connector 256 received in the receiver 154 while the larger bin 182 is shown with two connectors 258,260 received in the first and second receivers 152 and 154. Of course, some attachments may hold connectors received in two or more receivers with various connectors. It is also worthwhile to note that the spacing of the connectors 258,260 for the large bin is the same as the spacing and construction of the connectors of the cord wraps shown on FIG. 9. In this way, the various accessories can be made to be relatively interchangeable in location with one another. The connector 180 is also the same style and can be interchanged with the hooks 184,186 or located in any of the single receivers as is shown and described above.

Figure 12:
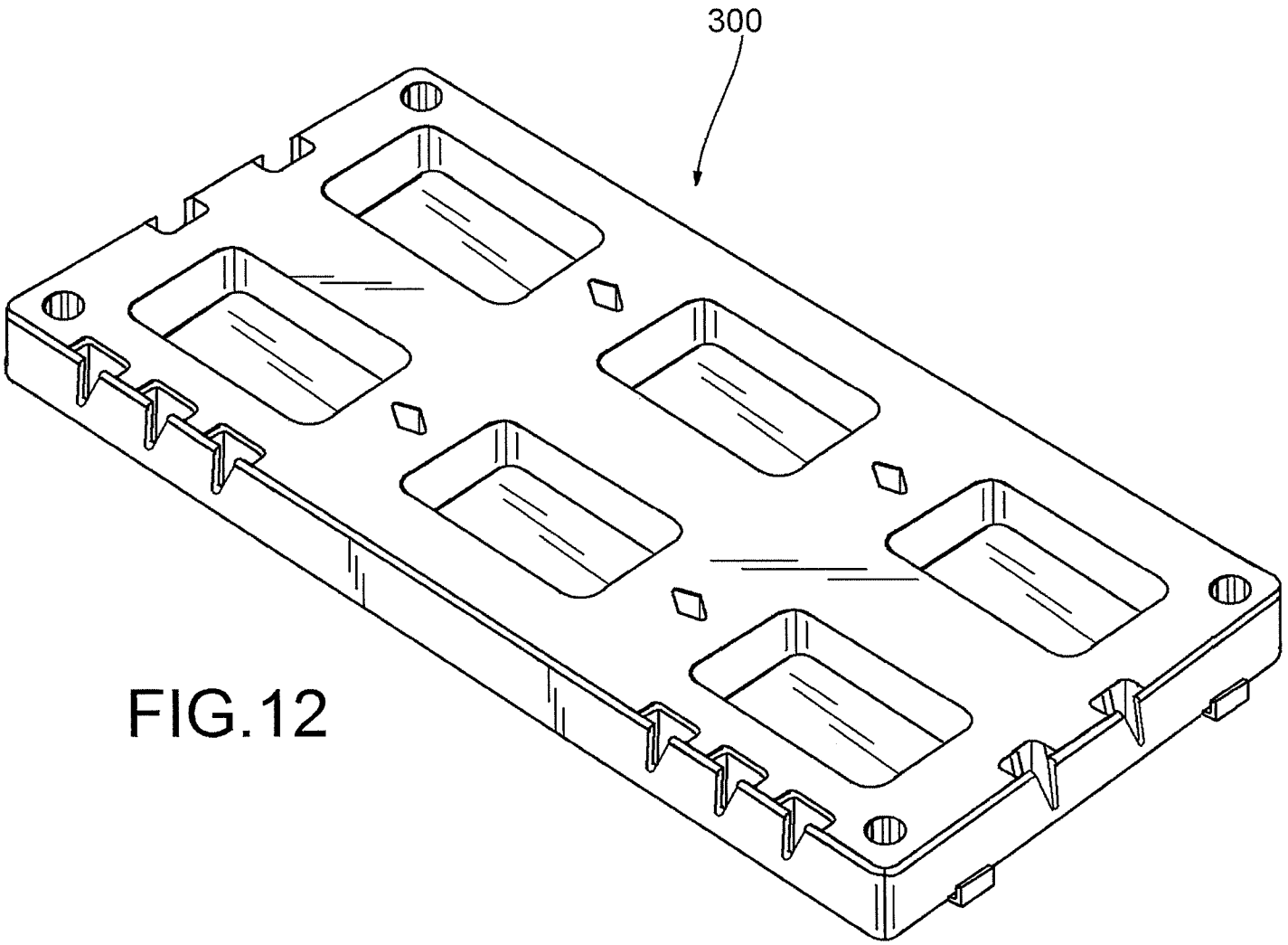
FIG. 12 is a first alternatively preferred embodiment of the second shelf configuration shown in FIGS. 1-9.

FIG. 12 shows a first alternately preferred embodiment of the second tray configuration 300. This tray configuration lacks the bar channel 112 shown in FIG. 5 and others. Otherwise, the illustrated second shelf configuration 300 is the same. Other embodiments may have other differences.

Figure 13:
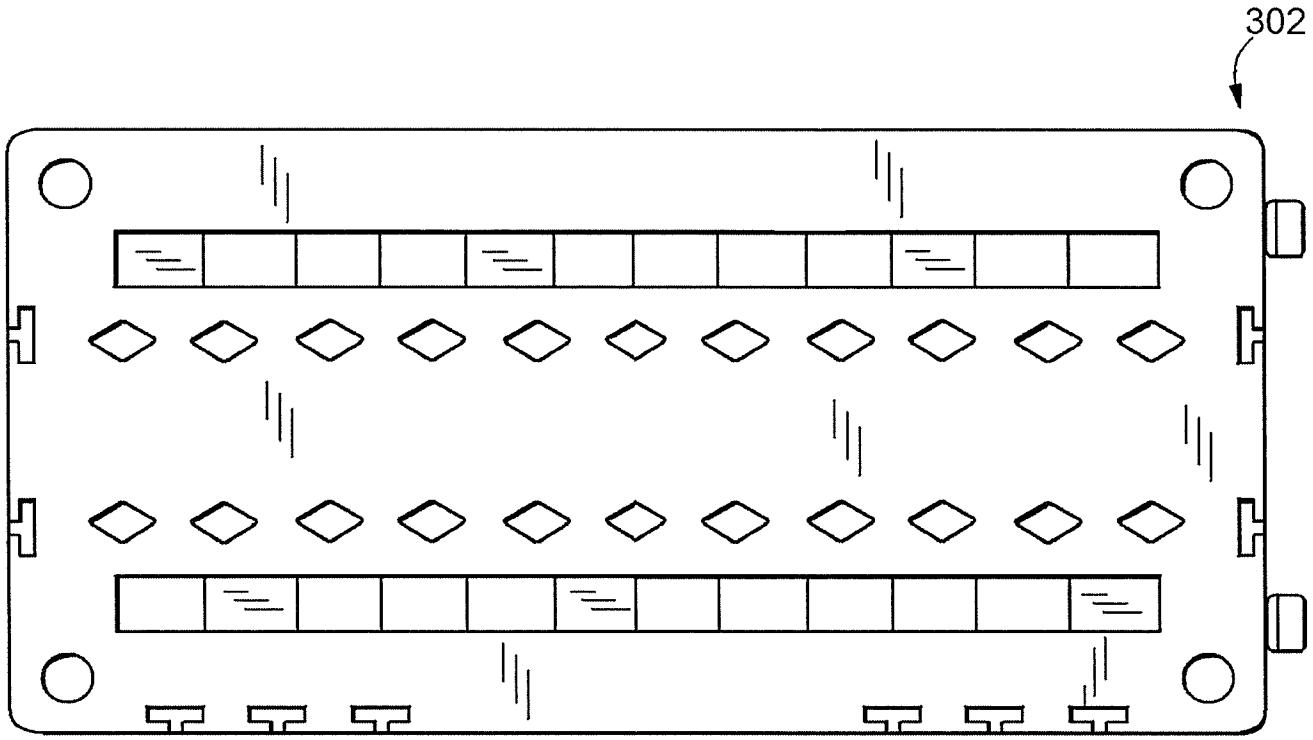
FIG. 13 is a top plan view similar to FIG. 2 with a first alternatively preferred embodiment.
Figure 14:
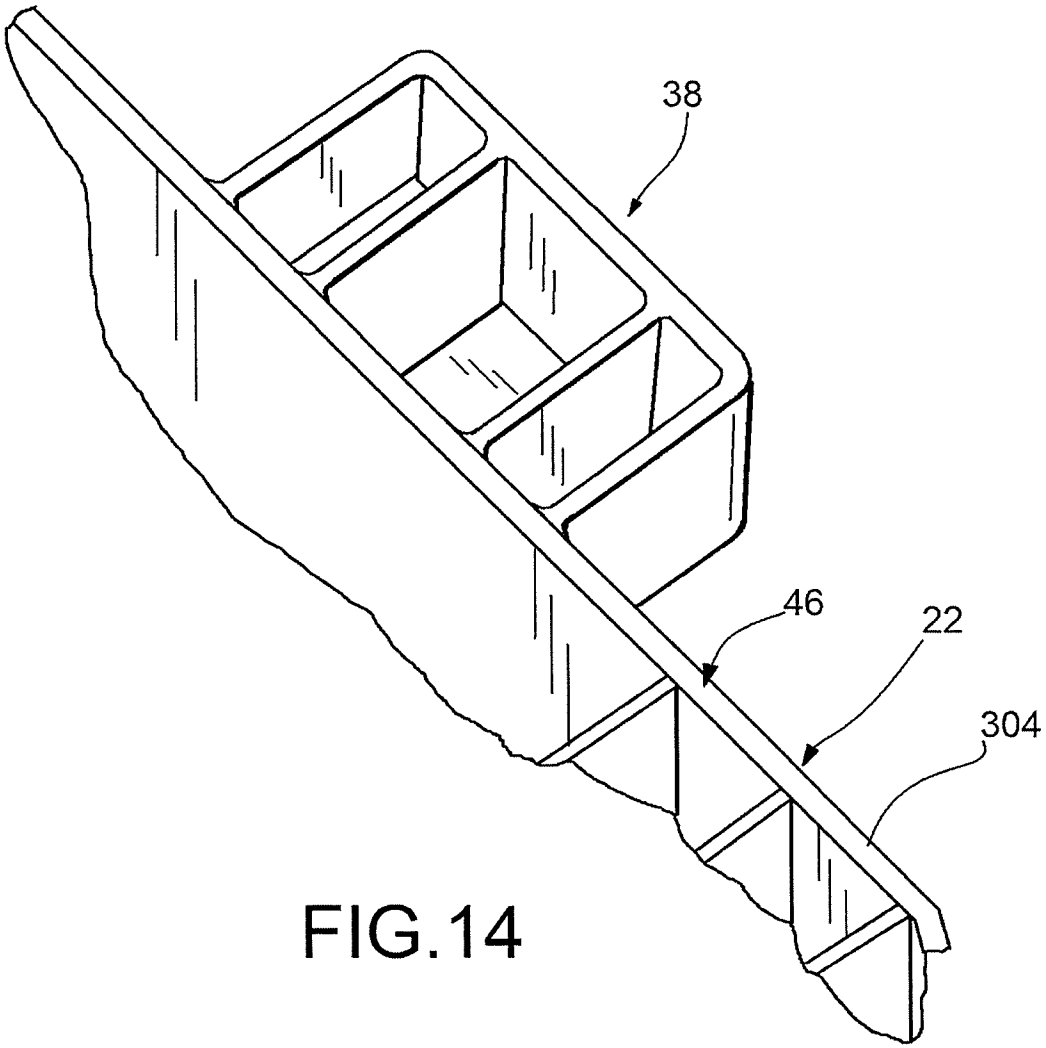
FIG. 14 is a bottom perspective view of the right side of the shelves shown in detail of the linking arm for use in connecting the side-by-side shelves together for stability when using multiple shelving units together such as is shown in a connected configuration of FIG. 1.

FIG. 13 shows a first preferred alternative embodiment of the first tray configuration 302. Once again, the central or third bar channel 64 has been omitted from this construction. FIG. 14 shows a bottom view of either a first or second shelf construction such as 22 illustrated at 24. One of the attachment legs 38 is shown to be integrally molded with the side wall 304 so as to provide the attachment leg 38 for cooperation with side-by-side adjacently connected first and/or second shelves' constructions 22,24. The attachment legs 38,40 make the side-by-side use of shelf systems 20,30 more robust so that they do not tend to move relative to one another to provide a more secure platform for storing things on the various shelves, such as any of the shelves illustrated in FIG. 1 or otherwise.

Of course, the various attachments such as attachments 180-194 are usual for connecting to the first or second shelf constructions 22,24 and supporting things relative to the first or second shelf constructions 22,24 for access by users such as small parts, cords, items supported by hooks. And, although four different attachments 180-194 illustrated, of course other attachments could be provided as are understood by the ordinary skill in the art.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A shelf kit comprising:

a first plastic shelf having a perimeter about a first planar upper surface;

a second plastic shelf having a perimeter about a second planar upper surface;

at least four legs for use in connecting the first shelf to the second shelf, whereby the first shelf is maintained parallel to the second shelf in an installed configuration by the at least four legs;

and at least one attachment selected from the group of a bin, a cable wrap, and a hook, said at least one attachment having a connector portion initially provided in an unattached configuration;

wherein at least one of the first and second shelves has at least one attachment location formed into said at least one of the first and second shelves through a side wall of said at least one of the first and second shelves for selectively receiving the connector portion of the at least one attachment in an attached construction, with the at least one attachment extending cantileveredly from the perimeter of the at least one of the first and second shelves when connected to the at least one attachment location with the connection portion of the at least one attachment and the at least one attachment located no higher than the planar upper surface of the at least one of the first and second shelves; and wherein the second shelf has a different upper surface configuration with at least one more bin formed within the second Planar upper surface than the first planar upper surface of the first shelf, wherein each bin of the second shelf has a planar non-perforated bottom that extends below the second planar upper surface of the second shelf.

2. The shelf kit of claim 1, wherein the at least one attachment is nested within a corresponding bin from said at Last one more bin formed in the second shelf.

3. The shelf kit of claim 1, wherein each attachment location of said at least one of the first and second shelves comprises a receiver which receives a corresponding connector portion of each attachment respectively in the attached construction.

4. The shelf kit of claim 3, wherein each receiver defines a slot that extends at least partially through a side of said at least one of the first and second shelves, and a passage internal to said at least one of the first and second shelves;

each connector portion having a neck extending through a corresponding slot, and a base received in a corresponding passage in the attached construction.

5. The shelf kit of claim 4, wherein each receiver has angled sides and each base has angled surfaces, wherein the angles sides of each receiver cooperates with the angled surfaces of a corresponding base to form a friction fit in the attached construction.

6. The shelf kit of claim 4, wherein a corresponding base is retained below the upper surface of said at least one of the first and second shelves in the attached construction.

7. The kit of claim 1, wherein the first shelf and the second shelf are in a stacked arrangement for customers to access items stored on the first shelf and the second shelf.

8. The kit of claim 1, further comprising, at least one third shelf that is identical to the first shelf.

9. The kit of claim 1, wherein the first shelf further comprises three parallel bar channels extending through the first planar upper surface for a length over half a width of the first shelf with one of the bar channels extending centrally relative to the first shelf as a central bar channel.

10. The kit of claim 9 wherein the three parallel bar channels each have dividers therein.

11. The kit of claim 10, wherein the second shelf has at least one second bar channel that extends through the second planar upper surface for a length over half a width of the second shelf.

12. The kit of claim 11, wherein the at least one more bin of the second shelf comprises at least two more bins formed into the second planar upper surface of the second shelf than the first planar upper surface of the first shelf, wherein the at least one second bar channel separates at least two of the at least two more bins of the second shelf.

* * * * *